US005718337A

United States Patent [19]

Carr et al.

[11] Patent Number: 5,718,337

[45] Date of Patent: Feb. 17, 1998

[54] CARTON FOR PLASTIC BAGS

[75] Inventors: Daniel G. Carr, Rochester; David J. Thomas; Toby R. Thomas, both of Pittsford; David V. Dobreski, Fairport, all of N.Y.

[73] Assignee: Tenneco Packaging Inc., Evanston, Ill.

[21] Appl. No.: 664,132

[22] Filed: Jun. 14, 1996

[51] Int. Cl.[6] ..... B65D 5/44

[52] U.S. Cl. ..... 206/554; 206/555; 229/122; 229/164; 229/178

[58] Field of Search ..... 206/554, 449, 206/555; 229/164, 165, 172, 174, 178, 122, 122.1, 162

[56] References Cited

U.S. PATENT DOCUMENTS

| | | | |
|---|---|---|---|
| 2,885,137 | 5/1959 | Guyer | 229/164 |
| 2,986,320 | 5/1961 | Nicholls et al. | 229/165 |
| 3,055,573 | 9/1962 | Carter | 229/178 |
| 4,196,843 | 4/1980 | Garmon | 229/165 |
| 5,052,615 | 10/1991 | Edward et al. | 229/178 |
| 5,277,360 | 1/1994 | DeMott . | |
| 5,337,950 | 8/1994 | Bower | 229/164 |
| 5,544,806 | 8/1996 | Anderson et al. | 229/178 |

FOREIGN PATENT DOCUMENTS

| | | | |
|---|---|---|---|
| 1237865 | 6/1971 | United Kingdom | 229/178 |

*Primary Examiner*—Paul T. Sewell
*Assistant Examiner*—Luan K. Bui
*Attorney, Agent, or Firm*—Arnold, White & Durkee

[57] ABSTRACT

A carton for a bag stack comprises a bottom wall, opposing front and back walls, and opposing first and second side walls bridging the opposing front and back walls. The first side wall forms a first pair of detents in proximity to the respective front and back walls. The second side wall forms a second pair of detents in proximity to the respective front and back walls. The front and back walls each include a profiled upper edge forming a window adapted to accommodate a human hand and allow retrieval of the plastic bags within the carton via the window. The bag stack includes first sets of plastic bags and second sets of plastic bags interleaved (alternately-arranged) with each other. Each set of plastic bags may include one or more plastic bags. The first and second sets of plastic bags are oriented in opposite longitudinal directions. The thickened portions of the first sets of bags are adjacent to and extend across the width of the front wall, while the thickened portions of the second sets of bags are adjacent to and extend across the width of the back wall. The distance between the first and second side walls is such that the first and second pairs of detents inhibit inward sliding of the interleaved sets of plastic bags, thereby maintaining the orderliness of the stack.

12 Claims, 7 Drawing Sheets

CARTON FOR PLASTIC BAGS

FIELD OF THE INVENTION

The present invention relates generally to cartons and, more particularly, to a carton for storing, shipping, and dispensing plastic bags in an orderly fashion.

BACKGROUND OF THE INVENTION

Plastic bags may be stored, shipped, and dispensed from conventional cartons having a bottom wall, opposing front and back walls, and a pair of opposing side walls. One technique for arranging the plastic bags in the carton is to simply stack them one on top of another with the bags oriented in the same direction. When the plastic bags include a thickened portion due to the use of zippers, peelable seals, added material, and the like, such an arrangement in a conventional carton is undesirable because the thickened portions of the bags are stacked on top of each other at one end of the stack such that the height of the stack is greater at this one end than in other regions. Such an imbalanced, uneven, and unstable stack can easily be disturbed during shipping and handling, causing the stored plastic bags to arrive at their destination in disorderly fashion. The bags have a tendency to slide down the downward slope formed by the uneven stack.

Another technique for arranging the plastic bags in the carton is to stack them one on top of another with alternate individual or sets of bags oriented in an opposite direction. Such an interleaved arrangement in a conventional carton is still undesirable because the stack is still imbalanced, uneven, and unstable. The thickened portions of the bags are stacked on top of each other at opposite ends of the stack such that the height of the stack is greater at these opposite ends than in the central region of the stack. Once again, the stack can easily be disturbed during shipping and handling because the bags having a tendency to slide down the downward slopes formed between the central region and opposite ends of the stack.

A need exists for a carton for storing, shipping, and dispensing plastic bags in an orderly fashion such that a stack of such plastic bags in the carton is not easily disturbed during shipping and handling.

SUMMARY OF THE INVENTION

A carton for a stack of plastic bags comprises a bottom wall, opposing front and back walls extending upwardly from the bottom wall, and opposing first and second side walls extending upwardly from the bottom wall and bridging the opposing front and back walls. The first side wall forms a first pair of detents in proximity to the respective front and back walls. The second side wall forms a second pair of detents in proximity to the respective front and back walls. The front and back walls each include a profiled upper edge forming a window adapted to accommodate a human hand and allow retrieval of the plastic bags within the carton via the window.

The bag stack includes first sets of plastic bags and second sets of plastic bags interleaved (alternately-arranged) with each other. Each set of plastic bags may include one or more plastic bags. The first and second sets of plastic bags are oriented in opposite longitudinal directions. The thickened portions of the first sets of bags are adjacent to and extend across the width of the front wall, while the thickened portions of the second sets of bags are adjacent to and extend across the width of the back wall. The distance between the first and second side walls is such that the first and second pairs of detents inhibit inward sliding of the interleaved sets of plastic bags, thereby maintaining the orderliness of the stack.

BRIEF DESCRIPTION OF THE DRAWINGS

Other objects and advantages of the invention will become apparent upon reading the following detailed description and upon reference to the drawings in which.

Figure 1:
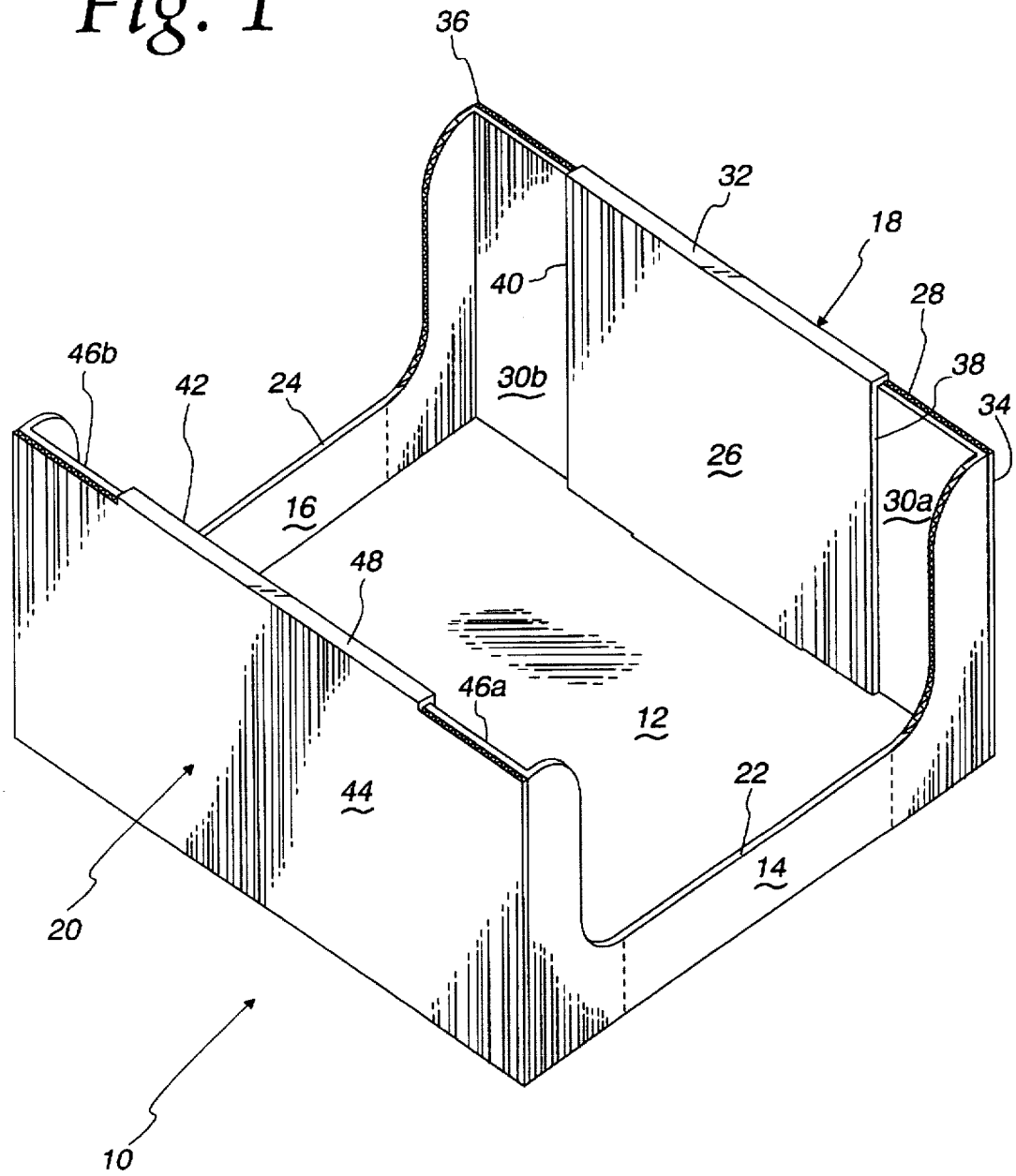
FIG. 1 is an isometric view of a corrugated carton embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Turning now to the drawings, FIG. 1 depicts a corrugated carton 10 for plastic bags in accordance with the present invention. Although the illustrated carton 10 is composed of corrugated board, the carton 10 may alternatively be composed of other suitable materials such as paperboard or fiber board. The carton 10 includes a bottom wall 12, opposing front and back walls 14 and 16, and opposing first and second side walls 18 and 20.

The opposing front and back walls 14 and 16 extend upwardly from and are generally perpendicular to the bottom wall 12. The front wall 14 includes a U-shaped upper edge 22 forming an access window adapted to accommodate a human hand and thereby allow retrieval with said hand of plastic bags stored within the carton 10. Similarly, the back wall 16 includes a U-shaped upper edge 24 forming another access window.

The first and second side walls 18 and 20 extend upwardly from and are generally perpendicular to the bottom wall 12 and bridge the opposing front and back walls 14 and 16. The first side wall 18 includes an inner panel 26, an outer panel 28, and a pair of intermediate flaps 30*a–b*. The intermediate flaps 30*a–b* are hingedly connected to the respective front and back walls 14 and 16 and are trapped between the inner and outer panels 26 and 28. Although not apparent from FIG.

Figure 5:
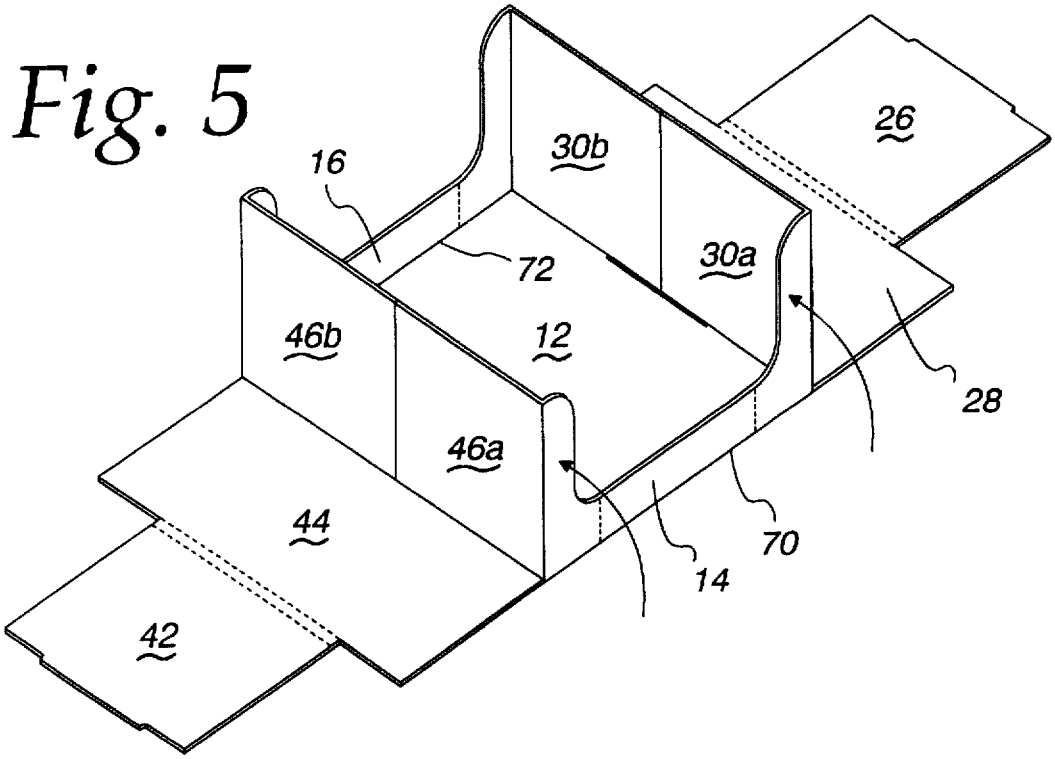
Figure 6:
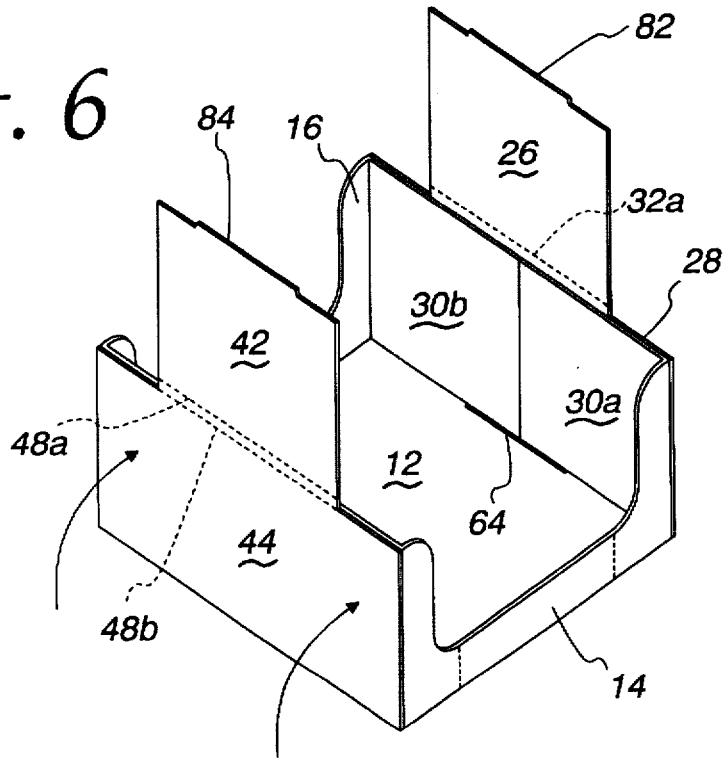

1, the concealed innermost edges of the intermediate flaps 30*a–b* meet each other at the center of the side wall 18 (see FIGS. 5 and 6). The inner panel 26 overlaps the outer panel 28 and is hingedly connected to the outer panel 28 along an upper stacking ledge 32. The full-width outer panel 28 extends between the front and back walls 14 and 16 and has a pair of opposing upright ends 34 and 36 immediately adjacent to the respective front and back walls 14 and 16. In contrast, the partial-width inner panel 26 has a width smaller than the width of the outer panel 28 such that its opposing upright edges 38 and 40 (referred to below as "detents") are in proximity to, but spaced from, the respective front and back walls 14 and 16.

Since the structure of the second side wall 20 is identical to the structure of the first side wall 18, the second side wall 20 is not described in detail herein. It suffices to state that the second side wall 20 includes an inner panel 42, an outer panel 44, and a pair of intermediate flaps 46*a–b*. The inner panel 42 is hingedly connected to the outer panel 44 along an upper stacking ledge 48.

Figure 2:
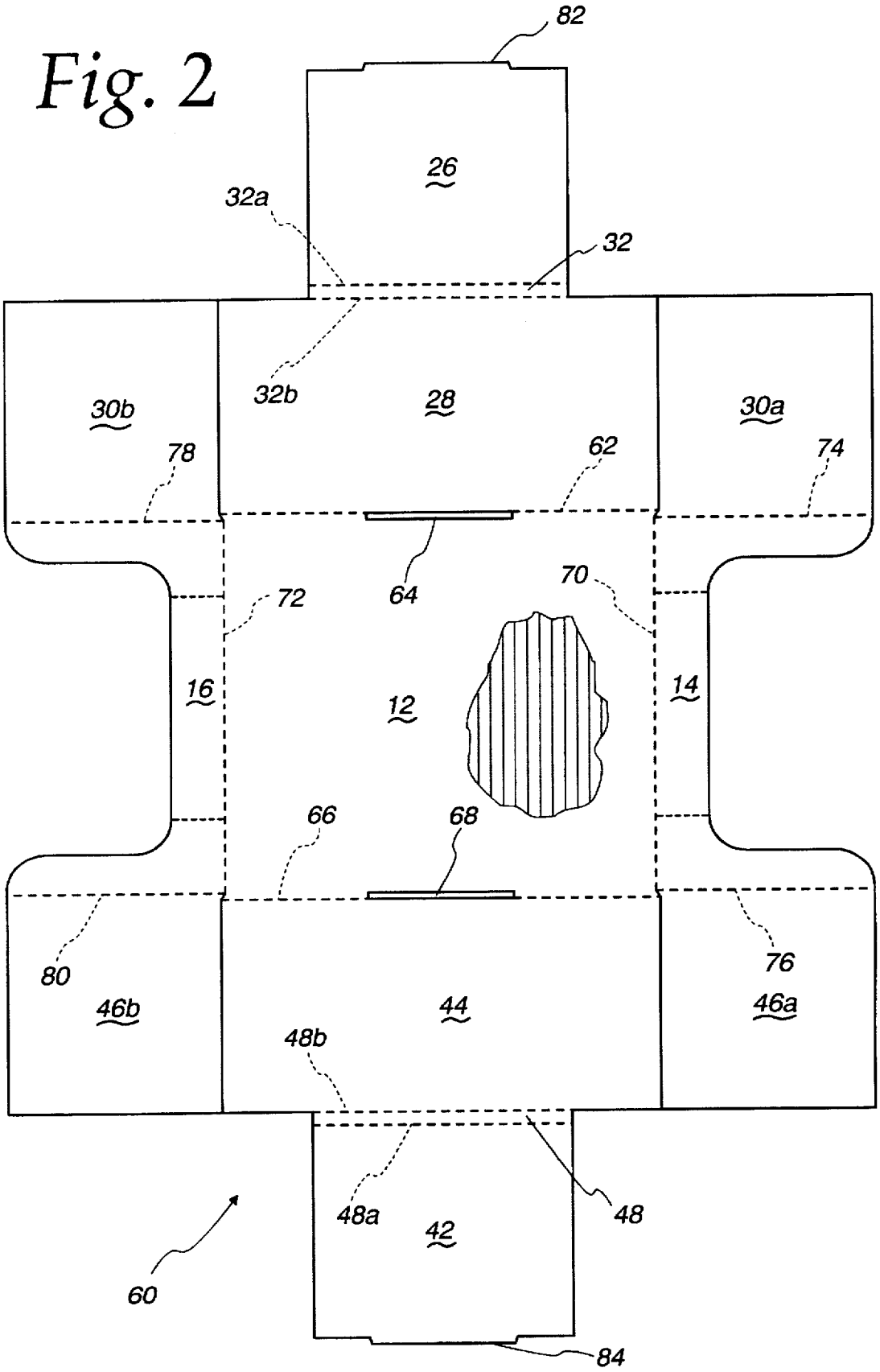
FIG. 2 is a plan view of an inside surface of a blank for forming the corrugated carton in FIG. 1.
Figure 3:
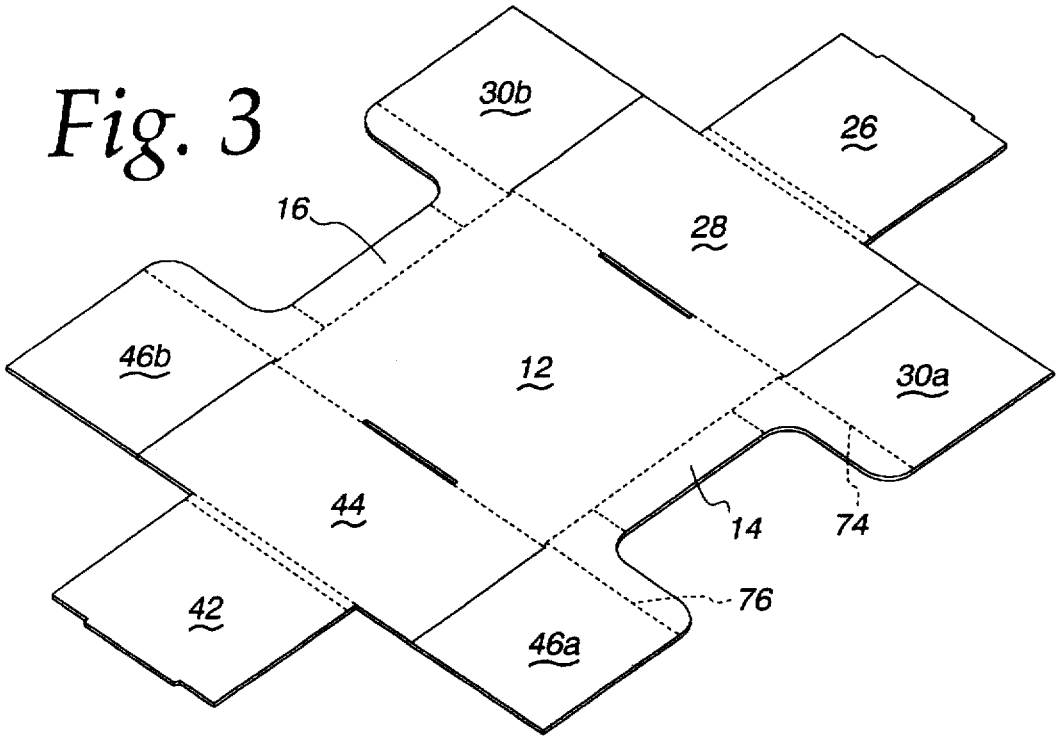
FIG. 3 is an isometric view of the blank for forming the corrugated carton in FIG. 1.

The corrugated carton 10 is formed from a unitary, continuous corrugated blank 60 depicted in FIG. 2. Panels of the blank 60 in FIG. 2 corresponding to portions of the carton 10 in FIG. 1 are designated by the same reference numerals. The blank 60 includes the inner side panels 26 and 42, the outer side panels 28 and 44, and the bottom wall 12 hingedly connected along a plurality of horizontal fold lines. More specifically, the inner and outer side panels 26 and 28 are hingedly connected along a pair of closely-spaced, parallel fold lines 32*a–b* which define the stacking ledge 32 previously mentioned in connection with FIG. 1. The outer side panel 28 and the bottom wall 12 are hingedly connected along a fold line 62 interrupted by an elongated intermediate slot 64. The bottom wall 12 is hingedly connected to the outer side panel 44 along a fold line 66 interrupted by an elongated intermediate slot 68. Finally, the inner and outer side panels 42 and 44 are hingedly connected along a pair of closely-spaced, parallel fold lines 48*a–b* which define the stacking ledge 48 previously mentioned in connection with FIG. 1.

The front wall 14, the bottom wall 12, and the back wall 16 are hingedly connected along vertical fold lines 70 and 72. The intermediate flaps 30*a* and 46*a* are hingedly connected to the front wall 14 along horizontal fold lines 74 and 76, while the intermediate flaps 30*b* and 46*b* are hingedly connected to the back wall 16 along horizontal fold lines 78 and 80.

The blank 60 in FIG. 2 is folded to form the carton 10 in FIG. 1 as illustrated in FIGS. 3–7. To achieve the blank configuration in FIG. 4 from the flat blank 60 in FIG. 3, the intermediate flaps 30*a* and 46*a* are folded upward approximately 90 degrees relative to the front wall 14 along the respective fold lines 74 and 76. Likewise, the intermediate flaps 30*b* and 46*b* are folded upward approximately 90 degrees relative to the back wall 16 along the respective fold lines 78 and 80.

Figure 4:
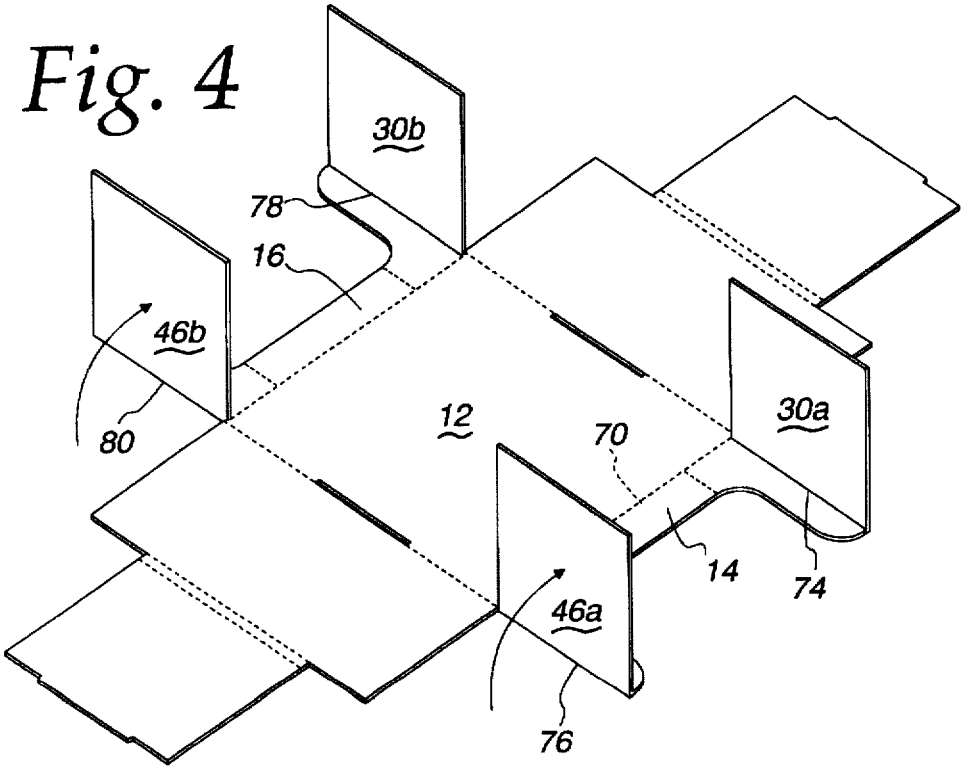
FIGS. 4, 5, and 6 are isometric views showing the sequence of folding the blank to produce the corrugated carton in FIG. 1.

To achieve the blank configuration in FIG. 5 from the blank configuration in FIG. 4, the front and back walls 14 and 16 are folded upward approximately 90 degrees relative to the bottom wall 12 along the respective fold lines 70 and 72.

To achieve the blank configuration in FIG. 6 from the blank configuration in FIG. 5, the outer side panel 28 is folded upward approximately 90 degrees relative to the bottom wall 12 along the fold line 62 (see FIG. 2), and the outer side panel 44 is similarly folded upward approximately 90 degrees relative to the bottom wall 12 along the fold line 66 (see FIG. 2).

Figure 7:
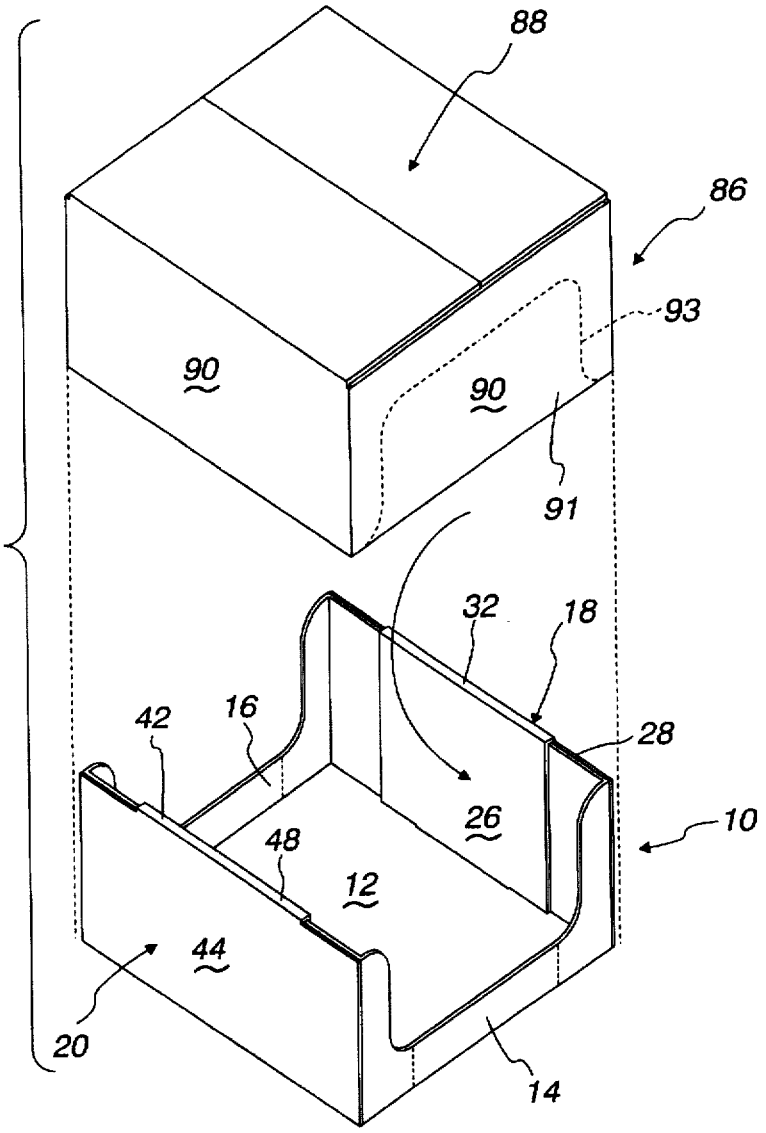
FIG. 7 is an exploded isometric view of the corrugated carton in combination with a removable corrugated cover.

The blank configuration in FIG. 6 is folded into the completed carton 10 depicted in the lower half of FIG. 7 by folding over the inner side panels 26 and 42. In particular, the inner side panel 26 is folded inward approximately 180 degrees relative to the outer side panel 28 along the parallel fold lines 32*a–b* defining the stacking ledge 32. The inner side panel 26 is retained in this folded position by inserting a locking tab 82 (FIGS. 2 and 6) into the elongated slot 64 (FIGS. 2 and 6). Similarly, the inner side panel 42 is folded inward approximately 180 degrees relative to the outer side panel 44 along the parallel fold lines 48*a–b* defining the stacking ledge 48. The inner side panel 42 is retained in this folded position by inserting a locking tab 84 (FIGS. 2 and 6) into the elongated slot 68 (FIG. 2).

To close the carton 10, a removable corrugated cover 86 may be provided. The exemplary cover 86 includes a top wall 88 and four side walls 90 extending downward from the top wall 88. The height of the cover 86 is approximately the same as the height of the carton 10, and the length and width of the cover 86 are slightly greater than the corresponding dimensions of the carton 10. Therefore, when the cover 86 closes the carton 10, the cover 86 fits snugly over the carton 10 such that the front wall 14, back wall 16, and side walls 18 and 20 of the carton 10 are substantially concealed by the cover 86. The cover 86 is advantageous in that it protects contents stored within the carton 10 during storage or shipping, when access to such contents is not needed. When access to the contents of the carton 10 is desired, the cover 86 may then be removed. Alternatively, the cover 86 may be provided with cutaway sections 91 (only one visible in FIG. 7) which negate the need to remove the cover 86 when access to the contents of the carton 10 is desired. When the cover 86 is on the carton 10, the cutaway sections 91 are aligned with the front and back windows of the carton 10 such that tearing away the cutaway sections 91 along lines of weakness 93 exposes the contents of the carton 10.

Figure 8:
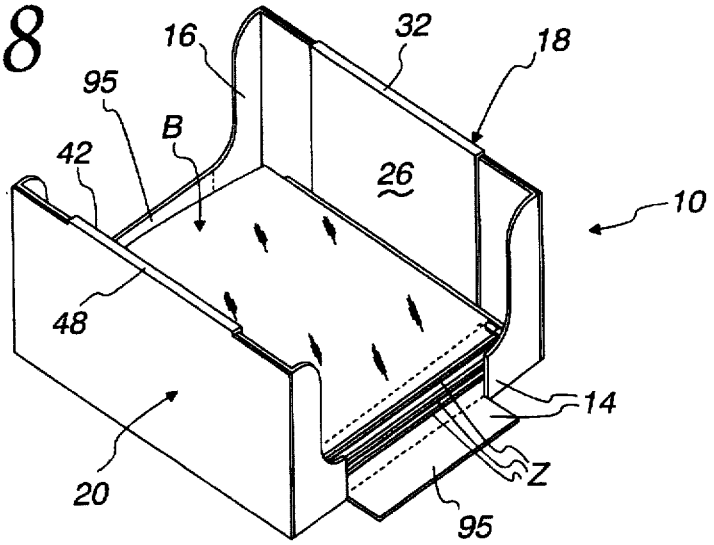
FIG. 8 is an isometric view of the corrugated carton with plastic bags stored therein.
Figure 9:
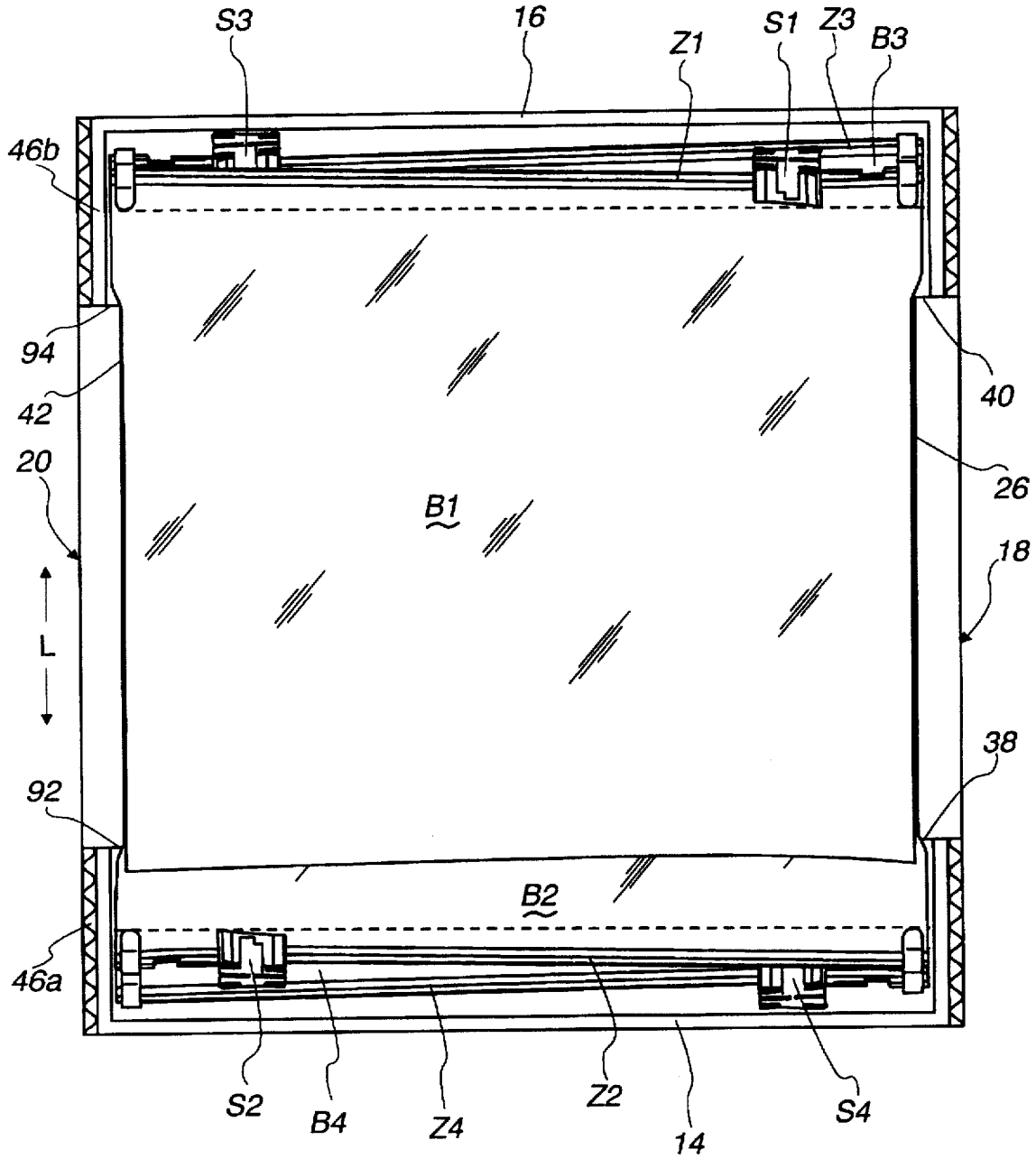
FIG. 9 is a top view of the corrugated carton with plastic bags stored therein.

Referring to FIGS. 8 and 9, the carton 10 is preferably used to store a stack of plastic bags B having thickened portions which, in the illustrated embodiment, are shown as zippers Z. The bag stack includes first and second interleaved (alternately-arranged) sets of plastic bags B. Although each set of plastic bags B in the illustrated embodiment includes a single bag, it should be understood that multiple bags may be included in each set. The first sets of plastic bags (e.g., bag sets B2 and B4 in FIG. 9) are oriented in a first longitudinal direction and have zippers (e.g., zippers Z2 and Z4 in FIG. 9) generally adjacent to and extending across the width of the front wall 14. The second sets of plastic bags (e.g., bag sets B1 and B3 in FIG. 9) are oriented in a second longitudinal direction opposite to the first longitudinal direction and have zippers (e.g., zippers Z1 and Z3 in FIG. 9) generally adjacent to and extending across the width of the back wall 16. The longitudinal direction is designated in FIG. 9 by an arrow labeled "L". The zippers of the first and second sets of plastic bags B are generally perpendicular to and extend between the first and second side walls 18 and 20.

If the plastic bags B are provided with zipper-opening sliders S of the type disclosed in U.S. Pat. No. 5,067,208, the first sets of plastic bags oriented in the first longitudinal direction are alternately-arranged with their obverse (front) and reverse (back) panels facing upward, and the second sets of plastic bags are alternately arranged with their obverse and reverse panels facing upward. Such obverse/reverse interleaving prevents the stack of bags B from becoming imbalanced due to the sliders S. For example, in FIG. 9 although the bag sets B1 and B3 are both oriented in the second longitudinal direction, the obverse side of bag set B1 faces upward while the reverse side of bag set B3 faces upward so that the sliders S1 and S3 do not overlap each other. Likewise, although the bag sets B2 and B4 are both oriented in the first longitudinal direction, the obverse side of bag set B2 faces upward while the reverse side of bag set B4 faces upward so that the sliders S2 and S4 do not overlap each other.

The carton 10 is designed to effectively store, ship, and dispense the plastic bags B in an orderly fashion such that a stack of such plastic bags in the carton 10 is not easily disturbed during shipping and handling. More specifically, the distance between the front and back walls 14 and 16 is greater than the length (longitudinal/vertical dimension in FIG. 9) of the bags B so that the interleaved first and second sets of plastic bags B can be longitudinally offset from each other so that they do not fully overlap. This insures that a user who grabs and removes the topmost bag from the carton 10 by grabbing onto its zipper does not accidentally grab the bottom portion of the bag beneath that topmost bag. For example, in FIG. 9 the bag sets B1 and B2 are longitudinally offset from each other. The zipper Z1 of the bag set B1 does not overlap the bottom portion of the bag set B2. Therefore, when a user grabs the zipper Z1 of the bag set B1 and removes the bag set B1 from the carton 10, the user will not accidentally grab the bottom portion of the bag set B2.

As best shown in FIG. 8, a user removes a bag B from the bag stack by reaching his or hand into the carton 10 and grabbing the topmost bag off the stack. If another carton is stacked on top of the carton 10, where the upper carton is supported by the stacking ledges 32 and 48, then the user may access the bags B within the carton 10 via the windows formed in the front and back walls 14 and 16. The windows are sufficiently large in size to easily accommodate a human hand. The front and back walls 14 and 16 may each be provided with a hinged or removable panel 95 to allow the size of the front and back windows to be increased.

The distance between the inner panels 26 and 42 of the respective side walls 18 and 20 is slightly less than the width (horizontal dimension in FIG. 9) of the bags B so that the zippers, which are located adjacent to the front and back walls 14 and 16 and away from the inner panels 26 and 42, extend outside the imaginary planes defined by the surfaces of the inner panels 26 and 42. As best shown in FIG. 9, the flexible body portions of the bags B are pressed slightly inward by the inner panels 26 and 42. Such inward pressure, however, is not imparted to the zippers of the bags B because the zippers are spaced away from the inner panels 26 and 42, where the distance between the intermediate panels 30*a* and 46*a* and between the intermediate panels 30*b* and 46*b* is slightly greater than the width of the zippers.

The foregoing distance parameters insure that the inner panels 26 and 42 will inhibit inward sliding of the bags B toward the center of the carton 10. More specifically, the inner panel 26 includes the opposing upright edges 38 and 40 which serve as detents, and the inner panel 42 includes opposing upright edges 92 and 94 which likewise serve as detents. If the bags B start to slide inward toward the center of the carton 10, the zippers catch on the most proximate pair of detents (either detents 38 and 92 or detents 40 and 94) so as to prevent further inward sliding of the bags B. The zippers do not pass over the detents because the zippers are significantly less flexible than the body portions of the bags B. For example, in FIG. 9 if the bag B1 starts to slide inward toward the center of the carton 10, the zipper Z1 catches on the detents 40 and 94. Thus, the bags B are maintained in an orderly fashion.

While the present invention has been described with reference to one or more particular embodiments, those skilled in the art will recognize that many changes may be made thereto without departing from the spirit and scope of the present invention.

For example, the plastic bags may all be oriented in the same longitudinal direction, and only the from wall of the carton may be provided with a window. In this case, only one detent on each side wall or one detent on one of the side walls is used to inhibit inward sliding of the plastic bags.

Figure 10:
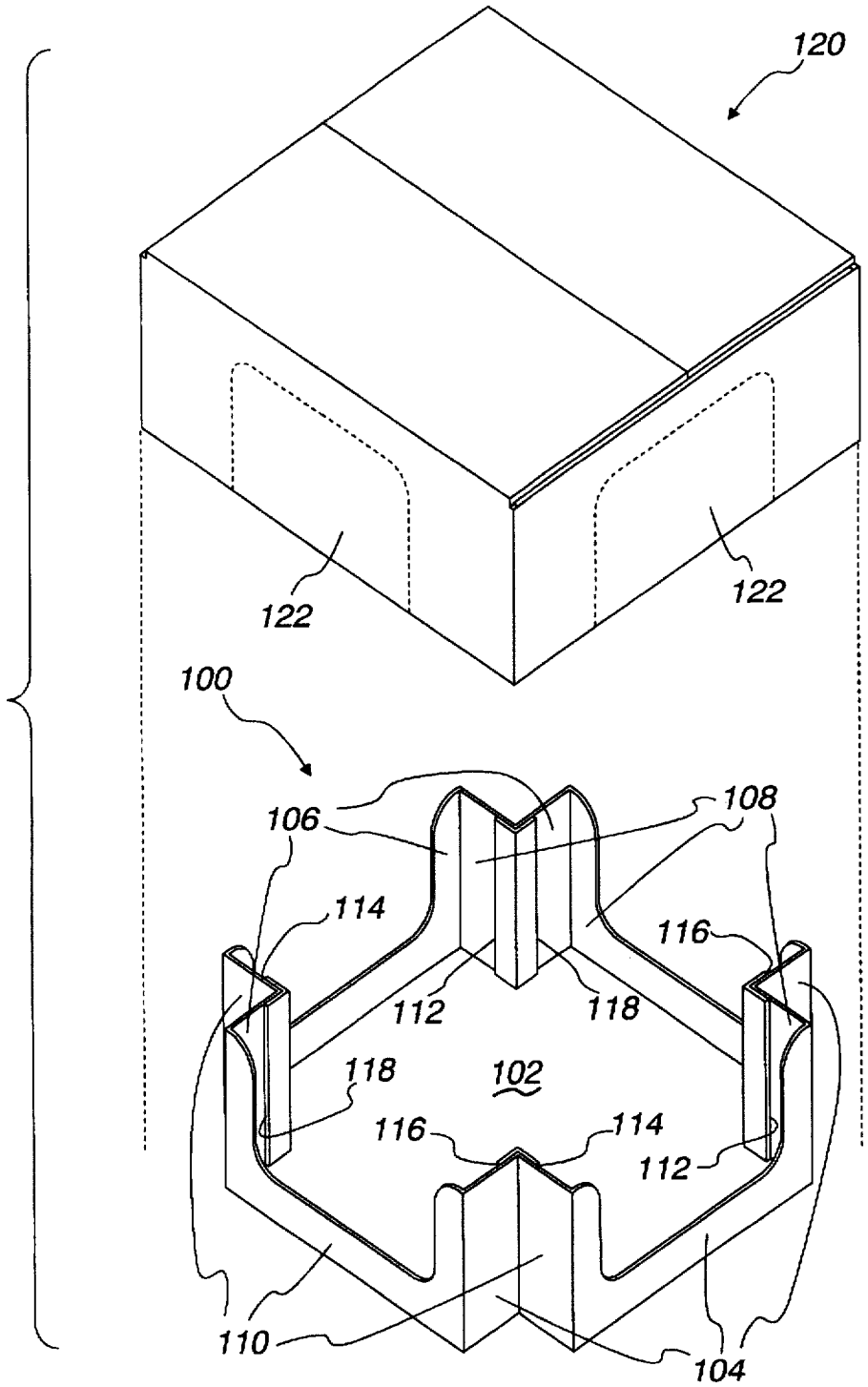
FIG. 10 is an exploded isometric view of a modified corrugated carton in combination with a modified removable corrugated cover.

In another embodiment shown in FIG. 10, the carton is modified to include a pair of detents on each of the front and back walls and to include windows formed in each of the opposing side walls. In particular, the carton 100 includes a bottom wall 102, front and back wails 104 and 106, and first and second side walls 108 and 110. Each of the four vertical walls includes a profile upper edge forming respective windows permitting four-way access to the contents of the carton 100. The first and second side walls 108 and 110 form respective first and second pairs of detents 112 and 114, and the front and back walls 104 and 106 form respective third and fourth pairs of detents 116 and 118. The first pair of detents 112 are in proximity but spaced from outermost portions of the respective front and back walls 104 and 106. Likewise, the second pair of detents 114 are in proximity but spaced from outermost portions of the respective front and back walls 104 and 106. The third pair of detents 116 are in proximity but spaced from outermost portions of the respective first and second walls 108 and 110. The fourth pair of detents 118 are in proximity but spaced from outermost portions of the respective first and second side walls 108 and 110.

With the foregoing construction of the carton 100, plastic bags can be oriented in all four directions (two longitudinal directions and two transverse directions), and the bags can be accessed through any vertical wall of the carton 100. In addition to the first and second sets of plastic bags described in connection with FIGS. 8 and 9, the bag stack includes third and fourth sets of plastic bags interleaved with the first and second sets of plastic bags. The bags may be further interleaved to alternate between their obverse and reverse panels facing upward. If the first and second sets of plastic bags are oriented in opposite longitudinal directions, the third and fourth sets of plastic bags are oriented in opposite transverse directions (perpendicular to the longitudinal directions). The first and second pairs of detents inhibit inward sliding of the first and second sets of plastic bags, while the third and fourth pairs of detents inhibit inward sliding of the third and fourth sets of plastic bags.

The carton 100 may be closed with a removable cover 120 which, like the cover 86 in FIG. 7, has cutaway sections 122 arranged to align with the carton windows when the cover 120 is on the carton 100.

Each of these embodiments and obvious variations thereof is contemplated as falling within the spirit and scope of the claimed invention, which is set forth in the following claims.

What is claimed is:

1. A packaged carton, comprising:

a bottom wall;

opposing front and back walls extending upwardly from said bottom wall;

opposing first and second side walls extending upwardly from said bottom wall and bridging said opposing front and back walls, said first side wall forming a first pair of detents in proximity to but spaced from said respective front and back walls, said second side wall forming a second pair of detents in proximity to but spaced from said respective front and back walls; and a bag stack disposed on said bottom wall and including first sets of plastic bags and second sets of plastic bags interleaved with each other, said first sets of plastic bags being oriented in a first direction and having first thickened portions generally adjacent to said front wall, said second sets of plastic bags being oriented in a second direction opposite to said first direction and having second thickened portions generally adjacent to said back wall, said first and second thickened portions having a predetermined width;

said first pair of detents being spaced from corresponding ones of said second pair of detents by a distance slightly less than the predetermined width of said first and second thickened portions such that said thickened portions catch on at least one of said detents of said first and second pairs of detents in response to said plastic bags sliding inward toward a central interior portion of the carton;

said front wall including a profiled front upper edge forming a front window permitting access to said first and second sets of plastic bags.

2. The packaged carton of claim 1, wherein said back wall includes a profiled back upper edge forming a back window, said first side wall includes a profiled first side upper edge forming a first side wall window, said second side wall includes a profiled second side upper edge forming a second side wall window, said back window, said first side wall window, and said second side wall window permitting access to said plastic bags.

3. The packaged carton of claim 2, wherein said front and back windows and said first and second side wall windows are sized to accommodate a human hand.

4. The packaged carton of claim 2, wherein said front wall forms a third pair of detents in proximity to but spaced from said respective first and second side walls, and said back wall forms a fourth pair of detents in proximity to but spaced from said respective first and second side walls.

5. The packaged carton of claim 4, wherein said bag stack further includes third and fourth sets of plastic bags interleaved with said first and second sets of plastic bags, said third sets of plastic bags being oriented in a third direction and having third thickened portions generally adjacent to said first side wall, said fourth sets of plastic bags being oriented in a fourth direction opposite to said third direction and having fourth thickened portions generally adjacent to said second side wall, said third and fourth directions being generally perpendicular to said first and second directions, said third and fourth thickened portions having the predetermined width.

6. The packaged carton of claim 5, wherein said third pair of detents are spaced from corresponding ones of said fourth pair of detents by a distance slightly less than the predetermined width of said third and fourth thickened portions such that said thickened portions catch on a proximate one or more of said detents of said third and fourth pairs of detents in response to said plastic bags sliding inward toward a central interior portion of the carton.

7. The packaged carton of claim 1, wherein each of said first sets of plastic bags includes a single bag, and wherein each of said second sets of plastic bags includes a single bag.

8. The packaged carton of claim 1, wherein said first side wall includes a first outer panel and a first inner panel, said first inner panel having a width less than a distance between said front and back walls such that said first inner panel includes opposing upright first edges spaced from said respective front and back walls, said opposing upright first edges forming said first pair of detents, and wherein said second side wall includes a second outer panel and a second inner panel, said second inner panel having a width less than the distance between said front and back walls such that said second inner panel includes opposing upright second edges spaced from said respective front and back walls, said opposing upright second edges forming said second pair of detents.

9. The packaged carton of claim 8, wherein said first and second sets of plastic bags have a width slightly greater than a distance between said first inner panel and said second inner panel.

10. The packaged carton of claim 1, wherein said first sets of plastic bags are alternately arranged with their obverse and reverse panels facing upward, and wherein said second sets of plastic bags are alternately arranged with their obverse and reverse panels facing upward.

11. The packaged carton of claim 1, wherein said first and second sets of plastic bags are longitudinally offset from each other such that said first thickened portions do not overlap said second sets of bags and said second thickened portions do not overlap said first sets of bags.

12. The packaged carton of claim 1, wherein said bag stack consists only of said first and second sets of bags.

* * * * *